US005774932A

United States Patent [19]

Mallory et al.

[11] Patent Number: 5,774,932

[45] Date of Patent: Jul. 7, 1998

[54] VACUUM CLEANER ASSEMBLY

[75] Inventors: James M. Mallory, Normal; Arnold L. Sepke, Hudson; David R. Sommer, Bloomington, all of Ill.

[73] Assignee: White Consolidated Industries, Inc., Cleveland, Ohio

[21] Appl. No.: 872,366

[22] Filed: Jun. 10, 1997

Related U.S. Application Data

[62] Division of Ser. No. 585,762, Jan. 15, 1996, Pat. No. 5,774,930.

[51] Int. Cl.[6] ..... A47L 9/14

[52] U.S. Cl. ..... 15/350; 15/352; 55/371

[58] Field of Search ..... 15/350, 351, 352; 55/371

[56] References Cited

U.S. PATENT DOCUMENTS

| | | | |
|---|---|---|---|
| 2,148,656 | 2/1939 | Smellie . | |
| 2,677,847 | 5/1954 | Smellie . | |
| 2,747,215 | 5/1956 | Segesman . | |
| 3,491,519 | 1/1970 | Ettridge | 15/350 X |
| 3,715,775 | 2/1973 | Nickelson . | |
| 4,573,236 | 3/1986 | Dyson . | |
| 4,621,390 | 11/1986 | Hampton et al. . | |
| 4,748,713 | 6/1988 | Sepke et al. . | |
| 4,811,450 | 3/1989 | Steadings . | |
| 5,107,567 | 4/1992 | Ferrari et al. | 15/350 |
| 5,134,750 | 8/1992 | King | 15/333 |
| 5,230,121 | 7/1993 | Blackman . | |
| 5,309,601 | 5/1994 | Hampton et al. . | |
| 5,367,741 | 11/1994 | Hampton et al. . | |
| 5,383,252 | 1/1995 | Hampton et al. . | |
| 5,414,893 | 5/1995 | Hampton et al. . | |
| 5,499,425 | 3/1996 | Glenn | 15/354 |
| 5,544,385 | 8/1996 | Jailor et al. | 15/350 |
| 5,606,770 | 3/1997 | Sovis et al. | 15/350 |

FOREIGN PATENT DOCUMENTS

| | | |
|---|---|---|
| 0 277 928 | 8/1988 | European Pat. Off. . |
| 1481154 | 7/1977 | United Kingdom . |
| 2144626 | 3/1985 | United Kingdom . |

*Primary Examiner*—Chris K. Moore

*Attorney, Agent, or Firm*—Pearne, Gordon, McCoy and Granger LLP

[57] ABSTRACT

An upright vacuum cleaner having a separable handle for compact shipping is disclosed. The separable handle includes a lower handle portion pivotally attached to a floor engaging unit and is joined to an upper handle portion at a parting plane. A dust bag cover is mounted to the lower handle portion by a mounting device. The mounting device comprises a baseplate comprises a mounting plate mounted on an exhaust duct of the cleaner extending from the lower handle portion and a dust bag cover support frame attached to the baseplate. All portions of the frame are located below the frame for shipping purposes. According to one aspect of the invention the support frame extends at right angles to the base plate and, according to another aspect of the invention, the frame is extendable above the parting plane to a use position.

3 Claims, 6 Drawing Sheets

VACUUM CLEANER ASSEMBLY

This is a divisional application of application Ser. No. 08/585,762 filed on Jan. 15, 1996, now U.S. Pat. No. 5,774,930.

BACKGROUND OF THE INVENTION

This invention relates, generally, to vacuum cleaners, and, more particularly, to upright vacuum cleaners with improved operational characteristics. Specifically, this invention relates to improvements in vacuum cleaners of the type set forth in U.S. Pat. Nos. 5,309,601; 5,383,252; 5,367,741; and 5,414,893. A number of assembly techniques and operational features are set forth in the above-noted prior art patents. These features improved the assembly and operational characteristics of an upright vacuum cleaner by providing a snap fit between elements of the floor engaging unit.

Another feature is the provision of a motor which is attachable to the end of the vacuum handle and which is rotatably mounted within the floor engaging unit of the vacuum cleaner.

A further feature includes the provision of the foot switch actuator assembly that allows actuation of the motor switch regardless of the position of the switch provided by the motor.

A further feature of the prior art is the provision of a combined elastomeric bumper or furniture guard and sealing gasket which cushions the front of the hood while sealing a portion of the union of the base and hood.

Other improvements include improvements in the suction channel between the vacuum cleaner filter bag and the rotatable brush, an improved mounting arrangement for the vacuum bag cover, and the provision of a cord or hose hook that slidably fits over the top of the handle.

SUMMARY OF THE INVENTION

The present invention is directed toward further improvements to an upright vacuum cleaner of the type set forth in the above-mentioned patents. An important feature of the present invention is the provision of a noise reducing muffler associated with the intake of the impeller fan. According to one aspect of the present invention, such a muffler arrangement is incorporated in a manually operated switch which alternately connects a vacuum intake of a vacuum cleaner between an accessory hose and the brush roll opening of the vacuum cleaner. More specifically, according to one aspect of the invention, the upright vacuum cleaner includes a floor engaging unit having a base. A motor is mounted in the base and has an impeller mounted at one end of a drive shaft. The base, at least in part, defines a vacuum plenum chamber having a first portion axially communicating with the impeller. A throttle ring is provided between the plenum chamber and the impeller in axially alignment with the impeller to reduce the cross-sectional area of the plenum leading to the impeller to bring the air inlet closer to the impeller, and to thereby reduce the noise of the vacuum cleaner. A sound absorbing pad is positioned within the plenum chamber at a location which is in axial alignment with the impeller to further reduce the noise.

Another feature of the present invention is the provision of a diverter valve in the plenum chamber which comprises a hollow tube rotatably mounted in the first portion of the chamber in axial alignment with the impeller. An opening is provided in the hollow tube which is adapted to alternately provide fluid communication between the first portion of the plenum chamber and a second portion which is connected to an accessory port upon rotation of the tube.

A further feature of the invention is the provision of a dust bag mounting device which permits the vacuum cleaner to be contained in a smaller shipping box by reducing the effective length of a portion of the handle of the vacuum cleaner when an upper portion of that handle is disassembled for shipping. According to this aspect of the invention, the dust bag mounting device comprises a base plate mounted on the exhaust duct of the cleaner which is, in turn, associated with a blower separable portion of the operating handle of the cleaner. The exhaust duct extends through an aperture in the baseplate and a dust bag support frame is attached to the baseplate to support the dust bag. With the handle separated for shipping, the dust bag support frame is positioned below a parting plane for the handle. According to one aspect of this invention, the frame includes a loop extending outwardly from and at substantially right angles to the baseplate. According to another aspect of the invention, the loop extends upwardly from and substantially parallel to the baseplate and is moveable between a first locked position below the parting plane for shipping purposes and a second locked position above the parting plane for operation after the handle is assembled.

According to a still further aspect of this invention, an improved adjustable wheel carriage is provided on the vacuum cleaner. According to this aspect of the invention, the floor engaging unit is supported above the floor by a plurality of floor engaging wheels. One set of the wheels is rotatably mounted on a fixed access at the rear of the unit and a second set of wheels are mounted on a wheel carriage which is pivotally attached to the unit. The wheel carriage has a cam-engageable surface laterally offset from a pivotable connection between the carriage and the unit. A height adjustment mechanism is mounted on the unit and comprises a tube having a manually adjustable grip at one end thereof, and a cam surface at the other end. The tube is rotatably mounted in the unit for rotation about its axis and has a cam surface in engagement with the cam-engageable surface of the carriage. A plurality of detents are provided between the tube and the unit so that the tube may be rotatably positioned in a number of adjusted positions. The cam surface is adapted to increase or decrease the space between the carriage and the unit by pivoting the carriage relative to the base and to pivot the base about the fixed access of the rear wheels so that the rotary brush of the unit may be raised or lowered relative to the surface to be cleaned. Prior art arrangements include detents between the adjustment mechanism and the carriage itself. Such detents tend to become worn as the carriage is repeatedly adjusted and in some cases, are completely erased from the cam surface so that certain adjusted positions are no longer functional.

DETAILED DESCRIPTION OF THE INVENTION

Figure 1:
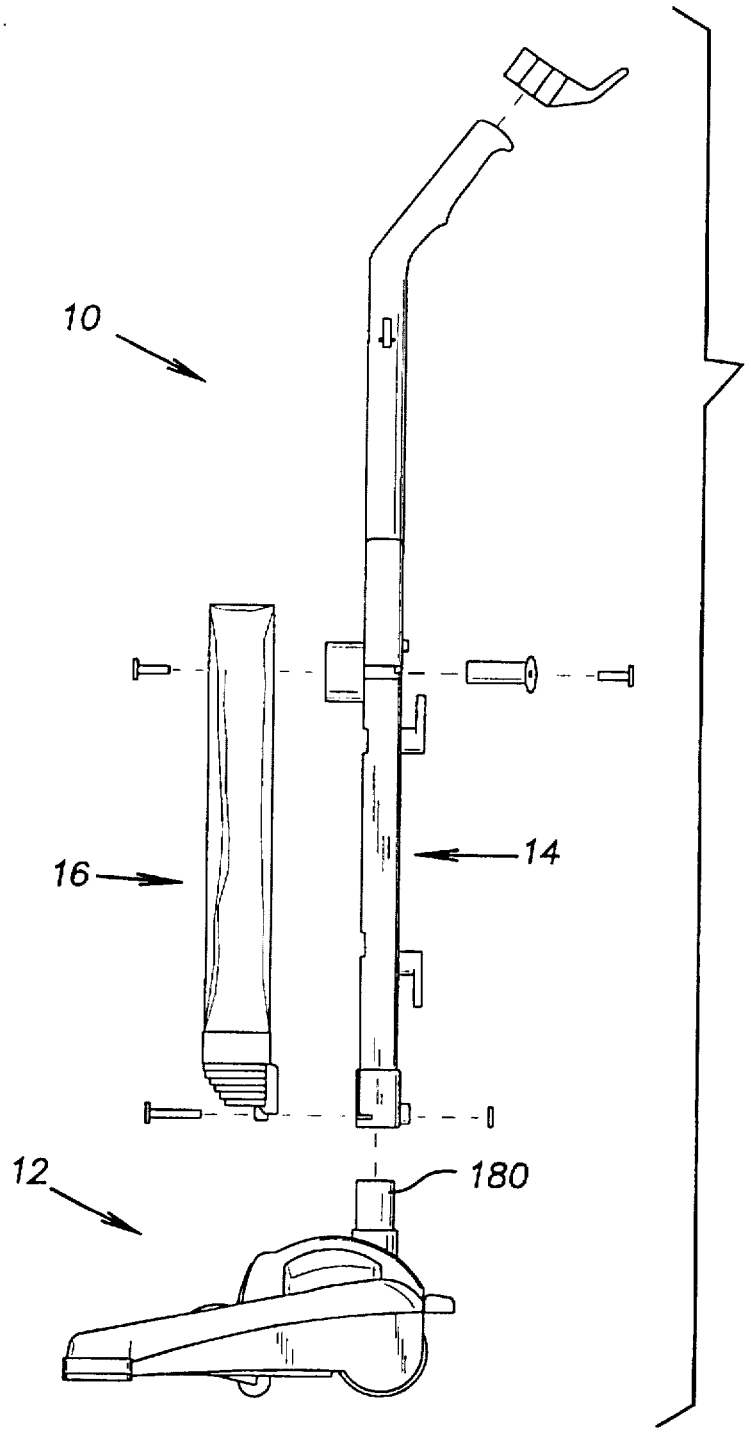
FIG. 1 is an exploded side elevational view of an upright vacuum cleaner in accordance with the present invention.
Figure 2:
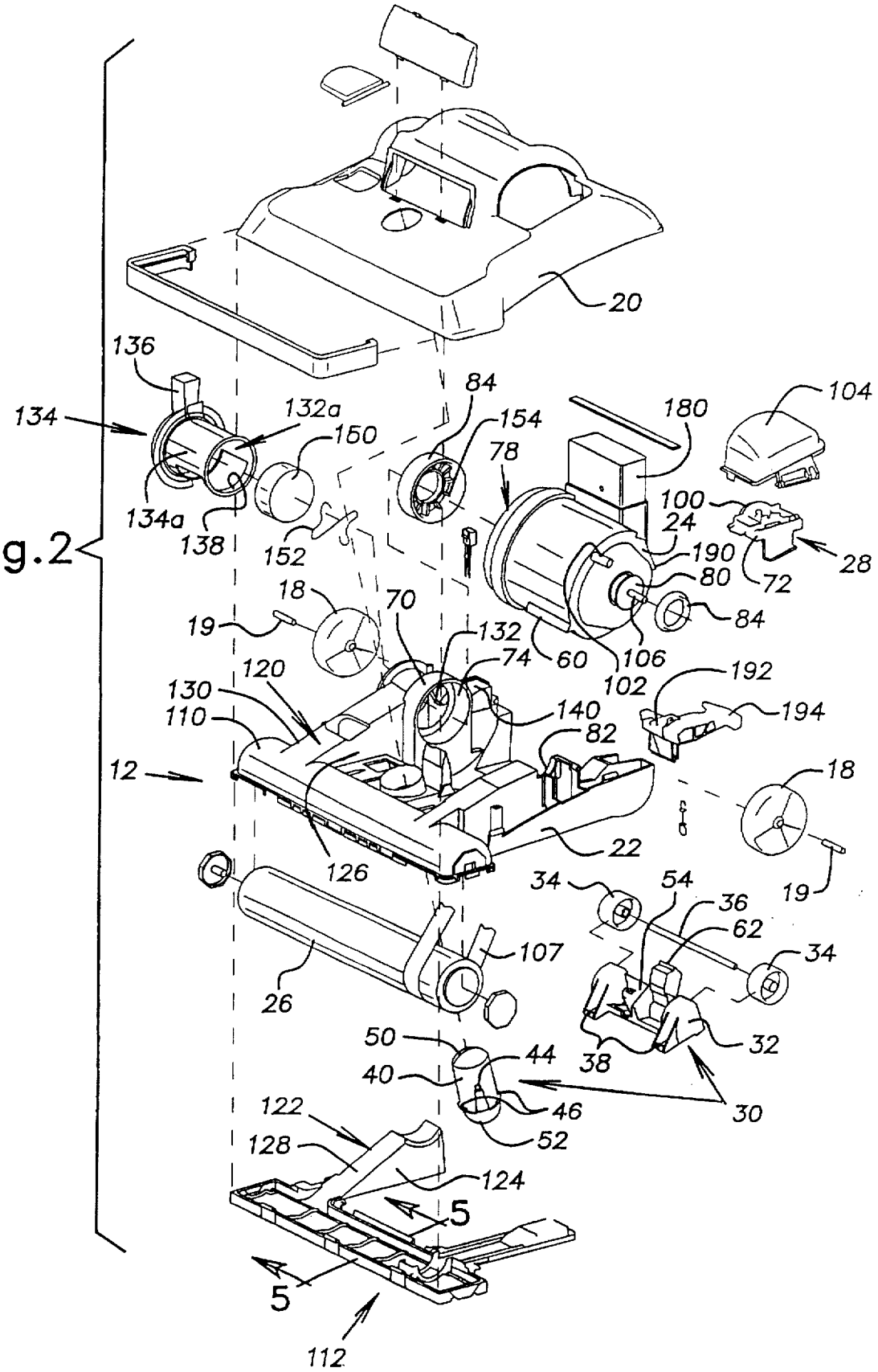
FIG. 2 is an exploded perspective view of the floor engaging unit of the present invention.

With reference to FIG. 1, an upright vacuum cleaner 10, produced in accordance with the present invention, is illustrated. The vacuum cleaner generally includes a floor engaging unit 12, a handle 14, and a vacuum bag cover 16. As best shown in FIG. 2, the floor engaging unit 12 is provided with a pair of rearwardly located snap-on wheels 18 which are mounted on stub shafts 19, a hood 20, a base 22, a rotatably mounted motor 24, a rotary brush 26, a foot switch actuator 28, and a height adjustment mechanism 30.

Figure 6:
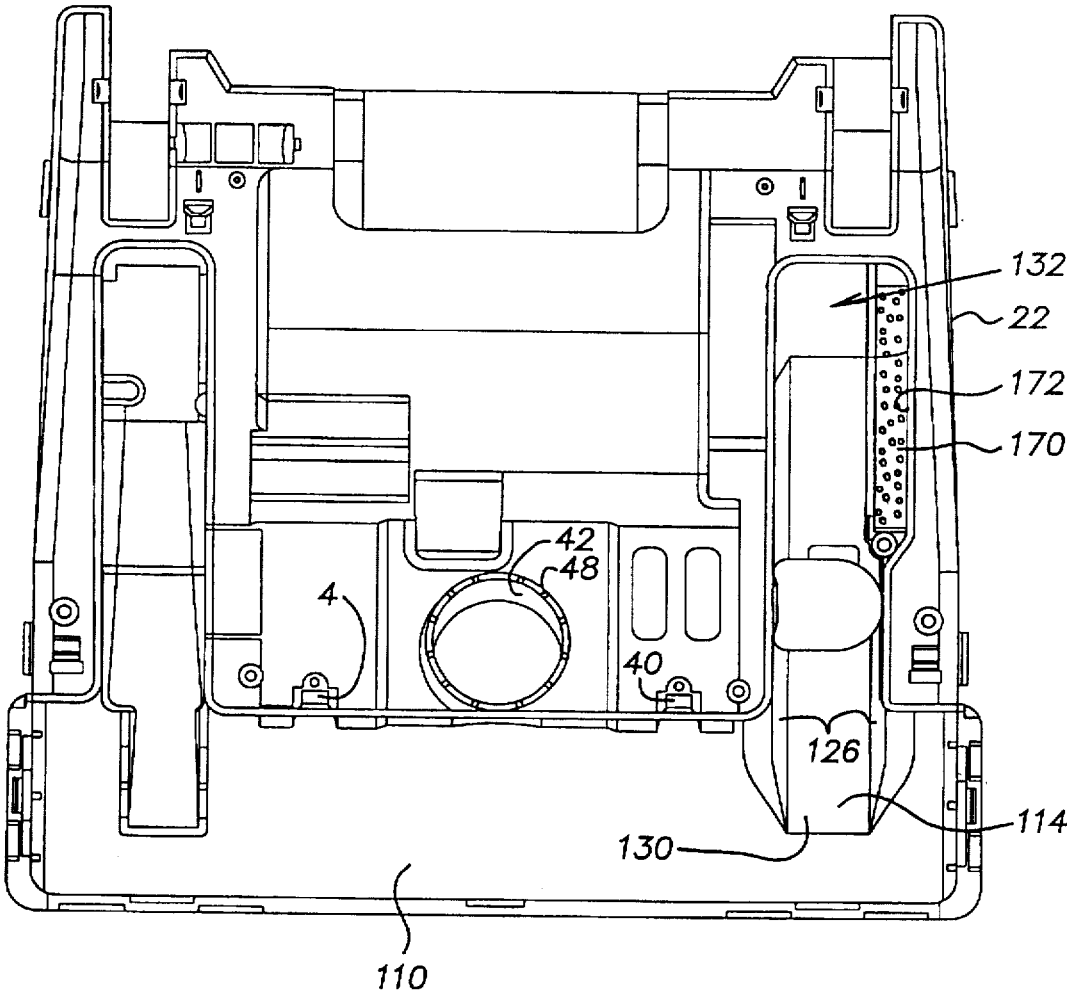
FIG. 6 is a bottom plan view of the base unit illustrated in FIG. 3.

The height adjustment mechanism 30 includes a wheel carriage 32 having wheels 34 mounted thereon by an axle 36. The wheel carriage includes pivot members 38 which are carried by pivot mounts 40 (FIG. 6). The carriage 32 is biased toward the base 22 by a spring (not shown). A height adjustment mechanism comprising a tube 40 is received in an aperture 42 in the base 22 and is retained therein by spring detent 44 and adjustment detent 46 on the tube 40. Thus, the tube 40 is mounted for rotation in the aperture 42 but is constrained against axial movement by the detents 44 and 46. The detent 46 cooperates with a multiplicity of detents 48 adjacent the aperture 42 to permit the tube 40 to be rotated by an adjusting knob 50 to any one of a multiplicity of rotated positions. An end of the tube 40 is provided with a cam surface 52 which engages a cam engaging surface 54 on the carriage 32. Rotation of the knob 50 causes the cam surface 52 to move the carriage 32 about the pivot connections 38 to raise and lower the wheels 34 relative to the base 22 and to thereby cause the base 22 to be raised or lowered by pivoting the base 22 about the axis of the rear wheels 18.

The rotatably mounted motor 24 includes an outwardly extending portion 60 which engages a projection 62 on the carriage 32 when the motor 24, via the handle 14, is moved into the vertical position, forcing the projection 62 and the carriage 32 to pivot about the pivot connections 38 and away from the base 22, thus increasing the distance between the rotary brush 26 and the surface to be cleaned. It is desirable for the brush 26 to be spaced from the floor surface when the handle 14 is in the vertical position to prevent the brush 26 from continuously beating the same spot on the floor. Conventionally, the handle 14 is placed in the vertical position when an accessory hose is used for off-the-floor cleaning. Naturally, engagement of the rotary brush 26 with the floor is unnecessary and undesirable during off-the-floor cleaning operations.

The rotatably mounted motor 24 is received and retained in the base 22 of the floor engaging unit 12 by means of a mounting block 70 and a mounting clip 72. The mounting block 70, which is provided by the base 22, defines a circular mounting aperture 74. The motor 24 is mounted to the base 22 by sliding an impeller end 78 of the motor into the circular mounting aperture 74, and laying a drive shaft end 80 of the motor 24 onto an inwardly curved mounting surface 82. The impeller end 78 of the motor includes a ring-shaped vibration and shock absorber 84 which rests on the aperture 74.

Figure 3:
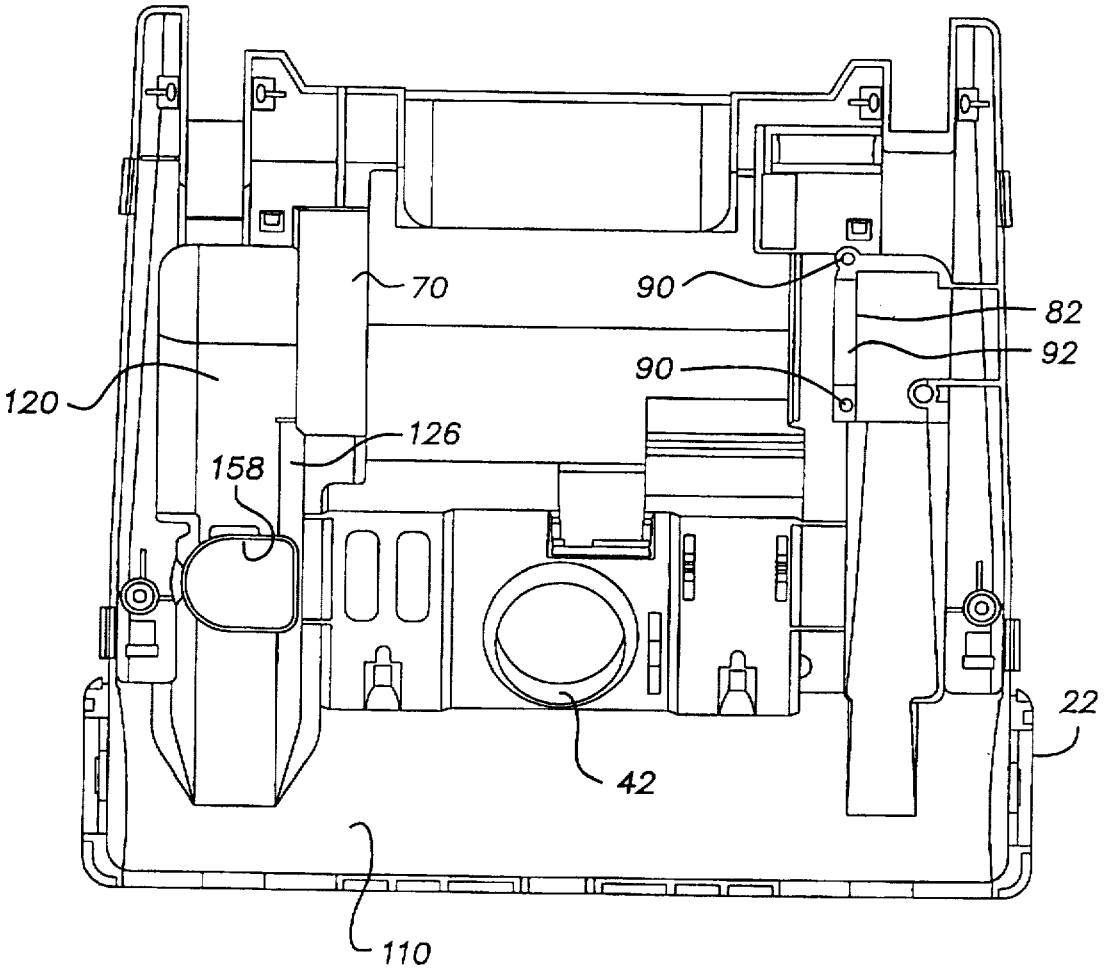
FIG. 3 is a plan view of the base of the floor engaging unit according to a modified aspect of the invention.

The mounting clip 72 is screwed onto the base 22 through apertures 90 (FIG. 3). An arcuate center section 92 receives the drive shaft end 80 of the motor 24. A vibration and shock absorbing ring 84 is provided and is received by the surface 82. The clip 72 is clamped onto the shock and vibration absorbing ring 84. Pivotally connected to the clip 72 is a switch actuating member 100 which operates a motor switch 102. A switch cover 104 is pivotally connected to the clip 72 and projects through the hood 20. The drive shaft end 80 of the motor 24 includes a drive shaft 106 which drives a belt 107 associated with the brush roll 26.

Figure 7:
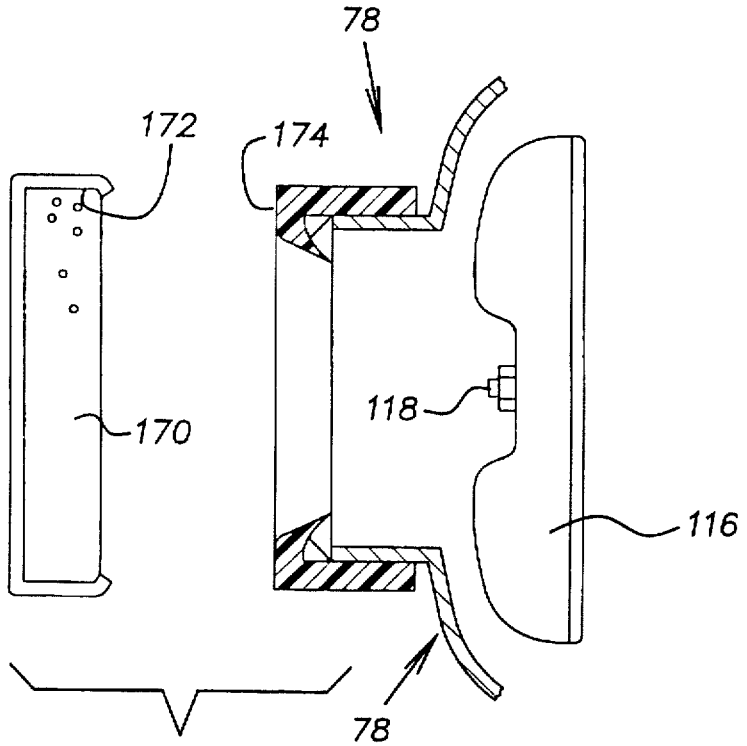
FIG. 7 is a semi-schematic view of the sound insulating assembly, according to this one aspect of invention.

The impeller end 78 of the motor serves as a conduit for air drawn from the area adjacent the rotary brush 26, or an accessory cleaning device, and delivers the same via the hollow handle 14, to a disposable vacuum bag (not shown) housed within the vacuum bag cover 16. Air is drawn from the mouth of a suction channel 110 which is formed by the base 22 and a bottom plate 112. A vacuum plenum chamber 114 (FIG. 6) communicates with the channel 110 and an impeller 116 (FIG. 7) on the motor drive shaft 118. The plenum chamber 114 is formed by a channel 120 in the base 22 and by the plate 112 which is provided with a nesting channel 122 and which has side walls 124 which closely nest with sidewalls 126 on the channel 120. The plenum chamber 114 is further defined by a space between an upper wall 128 of the channel 122 and an upper wall 130 of the channel 120. The chamber 114 includes a further portion 132 which is in axial alignment with the impeller 116.

According to one aspect of the invention, the chamber 132 comprises the hollow interior of a valve 134 which is mounted in the base 22 in axial alignment with the impeller 116 and which is rotated by a lever 136 between a position wherein a window 138 of the valve 134 provides communication between the channel 110 and the impeller 116 on the one hand and between an accessory connecting port 140 and the impeller 116 on the other hand. A foam sound absorbing pad 150 which may be a polymeric foam material, is retained in one end of the valve 134 by a retention spring 152. A throttle ring 154 is retained in the cushioning ring 84 and reduces the effective cross-sectional area of the intake opening to the impeller. It has been found that the combination of the sound absorbing pad 150 and the throttle ring 154 reduces the noise level of the motor by about 10 decibels.

Figure 8:
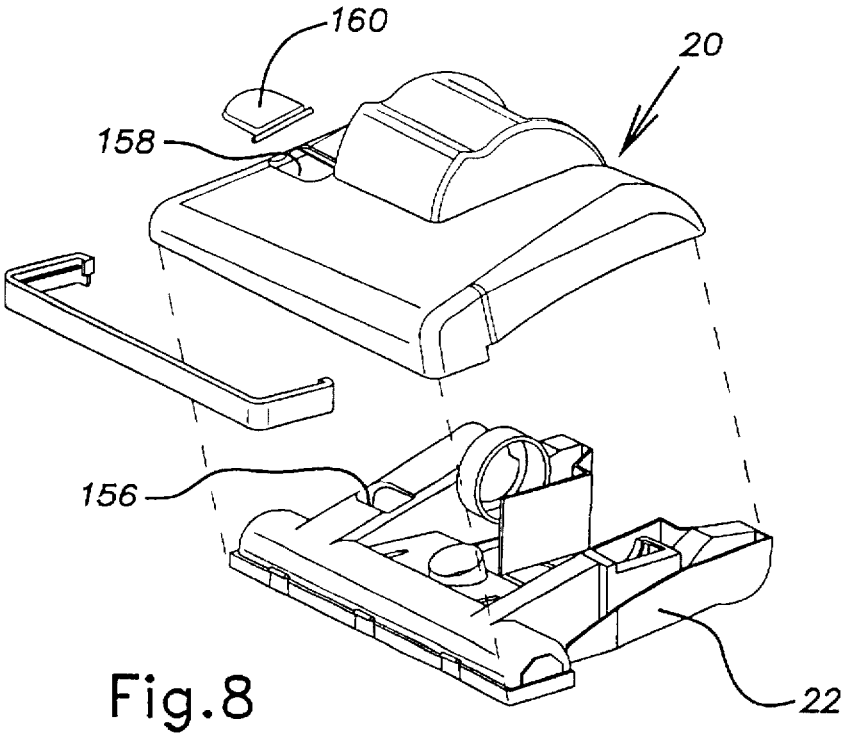
FIG. 8 is an exploded perspective view of that aspect of the invention illustrated in FIG. 3, 6 and 7.

According to an alternate embodiment of the invention, the selector valve 134 may be omitted and an access port 156 (FIGS. 3, 6, and 8) may be provided in the base 22 with a cooperating closable access port 158 in the hood 20. The cooperating access port 158 is provided with a hinged, spring biased cap 160 which normally closes the port 156 unless opened for the entry of an accessory hose. In the embodiment shown in FIGS. 3, 6, and 8 the sound absorbing mechanism is provided by a sound absorbing disk 170 (FIG. 6 and 7) which is received in a pocket 172 provided in substantial axial alignment with the impeller 116. As may be seen in FIG. 7 a throttle ring 174 reduces the cross-sectional area of the plenum chamber leading to the impeller fan 116.

The motor 24 provides an outwardly directed handle receiving member 180. The handle receiving member 180 facilitates mounting of the handle 14 to the motor 24, as well as the connection of power to the motor. The handle receiving member 180 includes an electrical plug (not shown) which allows the motor 24 to connect to electrical power via the socket of an electrical cord (not shown) carried by the handle 14. The motor does not require any further wiring, all power and wiring being accomplished and provided by the connection to the electrical cord which, in turn, is plugged into a common electrical outlet by the operator.

The motor 24 further includes an inwardly notched portion 190 which engages a releasable stop 192 when the handle 14 is moved in the vertical position, releasably locking the handle 14 and the motor 24 in the upright or storage position. This is typically desirably when the vacuum cleaner 10 is to be used for above-the-floor cleaning with an accessory, as discussed previously. When it is desired to return to on-the-floor cleaning, or to move the handle to a non-vertical position, the pedal 194 of the releasable stop 192 is depressed, releasing the notched portion 190 of the motor 24 from engagement therewith and allowing the handle 14 to pivot.

Figure 4:
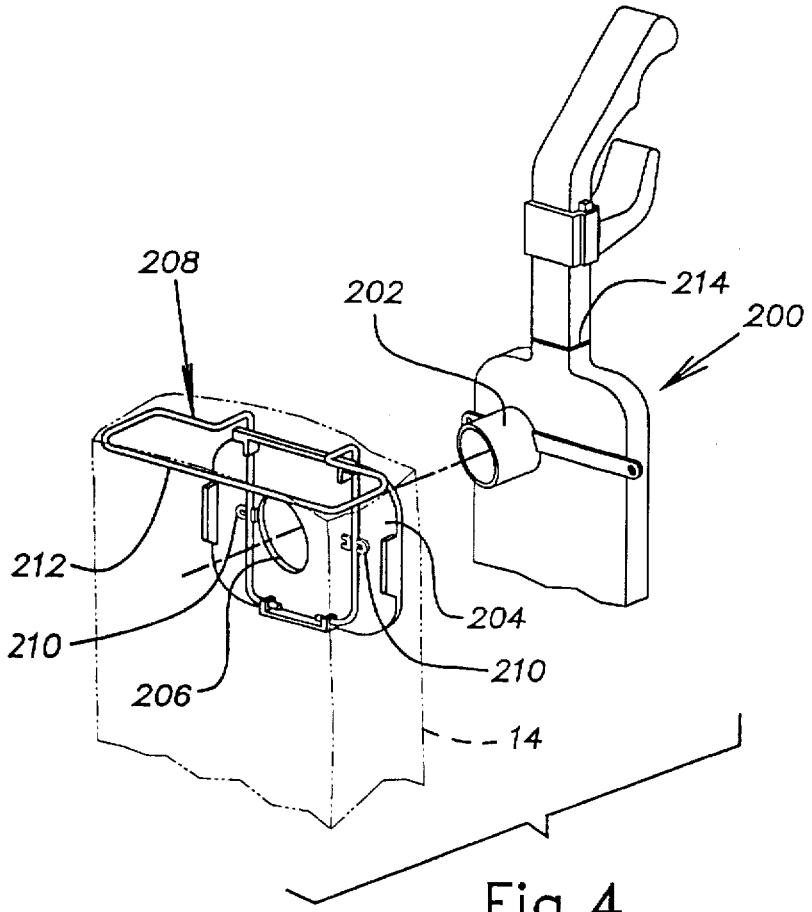
FIG. 4 is a perspective view of the handle and bag frame of the present invention, with the vacuum cleaner bag cover shown in phantom.
Figure 5:
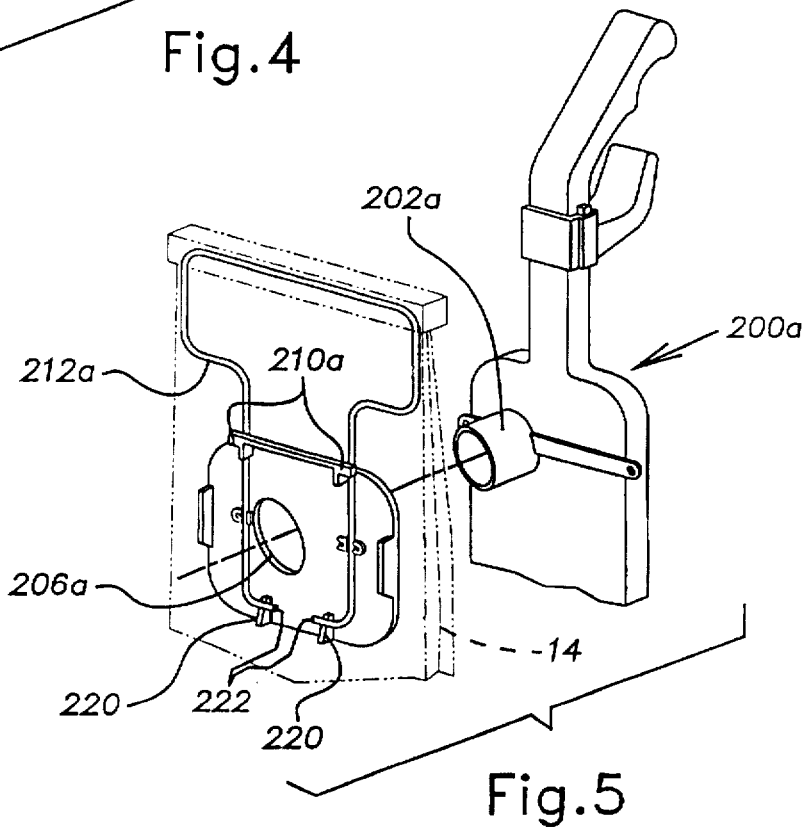
FIG. 5 is a view similar to FIG. 4 but showing another embodiment of a bag frame.

Upwardly spaced from the connection of the handle 14 to the motor 24, the handle provides a vacuum bag mounting means 200 and 200*a* (FIGS. 4 and 5 respectively). In FIG. 4 the vacuum bag mounting means 200 includes a cylindrical projection 202 and a fastener retention means 204. The cylindrical projection 202 extends through an aperture in the vacuum bag cover 16 and into a baseplate 204. The baseplate 204, which is sewn or otherwise permanently attached to the rear interior surface of the vacuum bag cover 16, includes an offset opening 206 for the receipt of the cylindrical projection 202. The baseplate 204 is attached to a vacuum bag support frame 208 by means of a plurality of resilient projections 210. The support frame 208, which is preferably formed of wire, engages the baseplate 204 and extends at right angles therefrom to form a loop 212 supporting the upper inside perimeter of the vacuum bag cover 16. The resulting configuration permits easier access to a disposable filter bag which cooperates with the opening 206 by expanding the vacuum bag cover 16 outwardly. Also, the outwardly extending loop 208 insures that the bag 16 does not project above a parting plane 214 on the handle. The parting plane 214 is a plane which determines the point of separation of the handle 14 for shipping purposes. If the bag cover 16 projected upwardly beyond the plane 214 additional inches would be added to the size of the shipping container, thus increasing shipping costs.

Referring now to FIG. 5, a baseplate 204*a* is attached to a vacuum bag cover support frame 208*a* by means of resilient projections 210*a* which permit the support frame 208*a* to slide downwardly from the position illustrated in FIG. 5. An upper loop 212*a* of the frame 208*a* is retained in its raised position by a pair of detent ramps 220 which retain hooked end portions 222 in the illustrated position but permit those hooked end portions 222 to be lowered so that the loop 212*a* may be retracted to a position below the parting plane 214 for shipping purposes as discussed above.

The foregoing description of the invention is illustrative of the preferred embodiment presently contemplated by the inventors, and is not to be construed in a limitive manner. Rather, since the invention is capable of being performed in several manners equivalent to the ones specifically described herein, the scope of the invention is only to be defined by the claims appended hereto.

What is claimed is:

1. An upright vacuum cleaner comprising a floor engaging unit and a handle pivotally attached thereto, a motor mounted in said floor engaging unit having an impeller for drawing dirt-laden air from a floor to be cleaned, an exhaust duct defining a passage for said dirt-laden air from said impeller to a porous dust bag cover, a dust bag cover mounting device attached to said handle, said mounting device comprising a baseplate mounted on said exhaust duct, said exhaust duct extending through an aperture in said baseplate, a dust bag cover support frame attached to said baseplate and supporting said dust bag cover so that said dust bag cover is in fluid communication with said exhaust duct, said handle having first and second separable portions separably joined at a parting plane , said first separable portion being pivotally attached to said floor engaging unit and having said dust bag cover mounting device attached thereto, all portions of said frame being positioned below said parting plane.

2. An upright vacuum cleaner according to claim 1 wherein said support frame includes a wire loop extending at right angles from said baseplate for supporting an upper inside perimeter of said dust bag cover.

3. An upright vacuum cleaner according to claim 1 wherein said support frame is moveable from a position below said parting plane to a position above said parting plane.

* * * * *

UNITED STATES PATENT AND TRADEMARK OFFICE

CERTIFICATE OF CORRECTION

PATENT NO. : 5,774,932
DATED : July 7, 1998
INVENTOR(S) : James M. Mallory et al.

It is certified that error appears in the above-identified patent and that said Letters Patent is hereby corrected as shown below:

On the face of the patent, under "FOREIGN PATENT DOCUMENTS" delete "2144626" and insert therefor --2144626A--.

Signed and Sealed this

Fifteenth Day of February, 2000

*Attest:*

Q. TODD DICKINSON

*Attesting Officer*

*Commissioner of Patents and Trademarks*